United States Patent [19]

Dussart et al.

[11] Patent Number: 4,962,793

[45] Date of Patent: Oct. 16, 1990

[54] PIN TYPE FAULTY WEFT EXTRACTOR

[75] Inventors: Jean-Luc Dussart, Sissonne; Richard David, Wasquehal; Bruno Grange, Satillieu, all of France

[73] Assignee: Picanol N.V., Belgium

[21] Appl. No.: 347,864

[22] Filed: May 5, 1989

Related U.S. Application Data

[63] Continuation-in-part of Ser. No. 273,477, Nov. 21, 1988, abandoned, which is a continuation of Ser. No. 29,759, Feb. 13, 1987, abandoned.

[30] Foreign Application Priority Data

Jun. 14, 1985 [FR] France ..... 85 09098

[51] Int. Cl.[5] ..... D03D 47/30

[52] U.S. Cl. ..... 139/116.2

[58] Field of Search ..... 139/1 R, 116.2, 435, 139/450, 452, 370.2

[56] References Cited

U.S. PATENT DOCUMENTS

| | | | |
|---|---|---|---|
| 4,063,575 | 12/1977 | Santi | 139/370.2 |
| 4,502,512 | 3/1985 | Suzuki et al. | 139/116.2 |
| 4,529,010 | 7/1985 | Aarts | 139/1 R |

FOREIGN PATENT DOCUMENTS

| | | |
|---|---|---|
| 0100939 | 7/1983 | European Pat. Off. . |
| 2140679 | 1/1973 | France . |
| 2248353 | 5/1975 | France . |
| 2320373 | 3/1977 | France . |
| 2537168 | 6/1984 | France . |
| 1400017 | 7/1975 | United Kingdom . |
| 1430520 | 3/1976 | United Kingdom . |

*Primary Examiner*—Andrew M. Falik

*Attorney, Agent, or Firm*—Bacon & Thomas

[57] ABSTRACT

A process for freeing up and removing defective picks during weaving includes inserting fine needles between the previous inserted weft and the just inserted weft before beating up of the latter and utilizing the needles to remove the defective pick by horizontally moving the defective pick toward the retracted reed in the shed. A suitable extraction means such as a suction tube removes the freed up weft thread from the shed area. Apparatus for carrying out the process includes a cam arrangement movable with the sley shaft to precisely coordinate the action of the needles, which move vertically into the fabric and horizontally to displace the defective pick toward the reed.

23 Claims, 5 Drawing Sheets

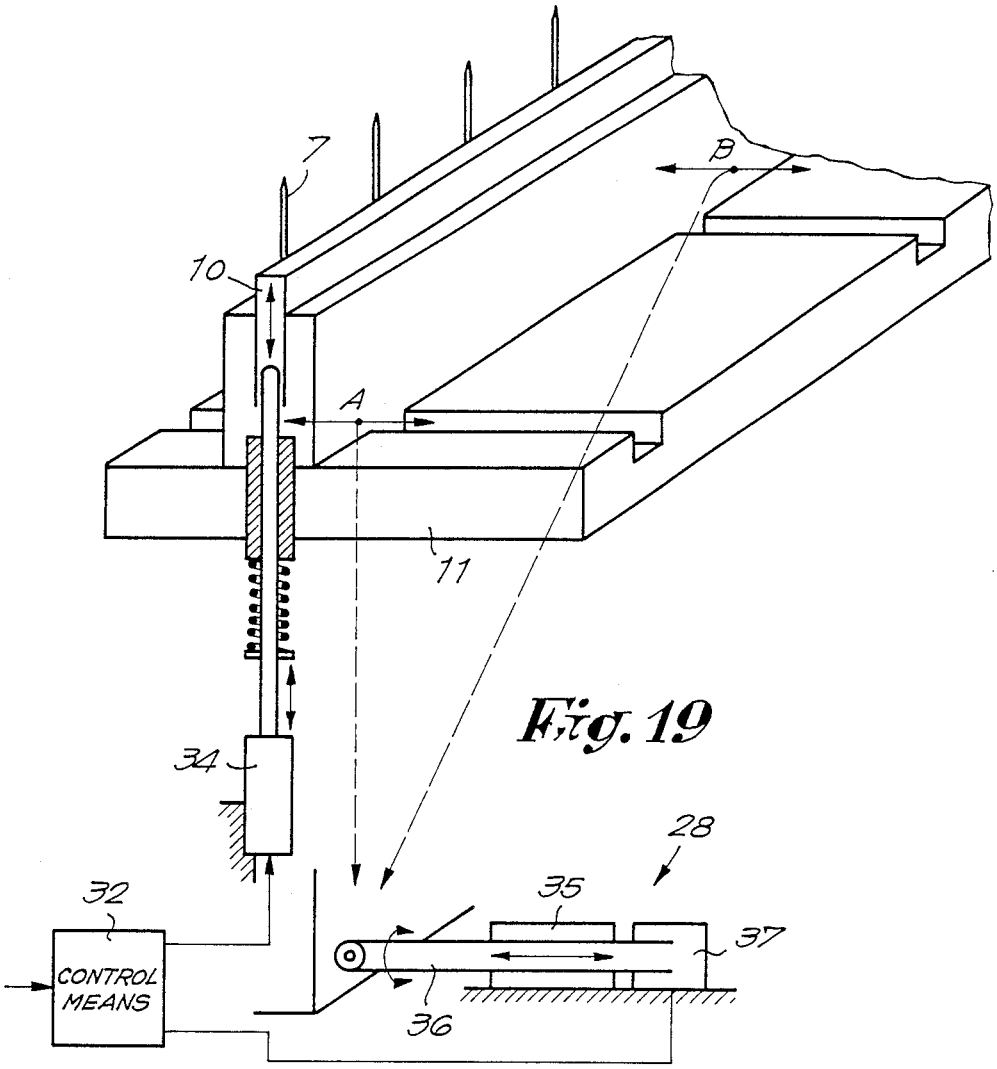
Fig. 19
Fig. 20(a)
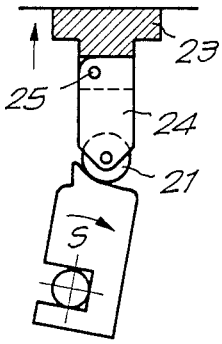
Fig. 20(b)
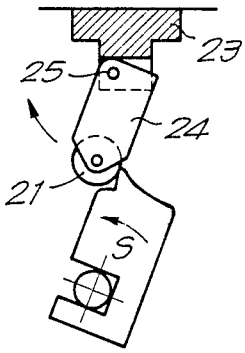
Fig. 20(c)
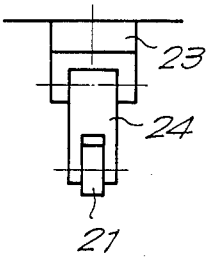

PIN TYPE FAULTY WEFT EXTRACTOR

This is a continuation-in-part of application Ser. No. 273,477, filed Nov. 21, 1988, abandoned which is a continuation of application Ser. No. 029,759, filed Feb. 13, 1987, and now abandoned.

BACKGROUND OF THE INVENTION

The present invention relates to the automatic extraction of defective weft threads or picks during weaving on a shuttleless loom, for example, an air jet loom. More specifically, the invention relates to the freeing of a defective weft thread from the fabric in order to facilitate its extraction.

Air jet looms conventionally utilize weft sensors that check if the weft thread that has been inserted in the warp is defective and, if a defective pick is sensed, include a system for stopping the loom. Usually, a mispick is manifested by a weft thread folded up on itself among the warp threads. The extraction of the defective pick usually is accomplished by the loom operator who, with the warp open, frees up the defective weft thread that has usually been beaten by the reed (sley) into the fell and cut at its inserted side, and extracts the defective weft by hand. Various devices have been proposed for accomplishing such extraction automatically. Usually, other devices include a means which is external of the fabric being woven and which only acts when the weft sensors have sensed and indicated a mispick.

For example, in French Patent No. 83,19156, the weft remover is placed at the insertion side of the loom and, in the event of a mispick, reciprocates in the direction of the weft through the warp, thereby moving the defective weft as it advances. The defective weft is only sensed by the device after the weft has been beaten into the fell of the fabric. According to European Patent Specification No. 83 10 7125.3, the defective weft remover is placed on the front part of the loom and above the fabric being woven. In this case, in the event of a defective pick, the remover drops and is introduced between the defective weft and the fabric in order to free the defective weft. Again, the introduction of the freeing means is carried out only after the beating up of the defective weft thread.

Obviously, the introduction of a freeing means between two weft threads beaten against one another is very difficult, if not impossible.

BRIEF SUMMARY OF THE INVENTION

The present invention relates to a process whereby, before the beating of the weft thread, at least in the case of a defective weft insertion, a weft freeing means is introduced between the previously inserted thread and the last or most recently inserted weft thread, such freeing means being capable of completely freeing the defective weft in order to remove it by means of a separate extraction means.

In accordance with one embodiment of the process contemplated by the invention, the process includes the following steps for each insertion cycle:

(a) a weft freeing means is introduced between the previously inserted weft thread and the last weft thread just inserted;

(b) the most recently inserted weft is checked and, (c) if it is not defective, the weft freeing means is withdrawn from the fabric and a new insertion cycle is commenced; or if the thread most recently inserted is defective, the loom is stopped and the reed is moved back toward its withdrawal or retracted position, the weft freeing means is shifted toward the reed for freeing the thread, and the defective weft thread is extracted.

According to the above embodiment of the process according to the invention, and contrary to prior art arrangements, the weft thread freeing means is precisely positioned and ready for action at every weft insertion cycle, whether the weft thread insertion is defective or not. If the weft thread is not defective, the freeing means is withdrawn from the fabric; on the contrary, if the weft thread just introduced is defective, the freeing means starts acting without having to trace the place of the defective thread nor to find its position in the fabric.

Evidently, according to the process of the invention, the process steps need not succeed one another necessarily in the precise sequence as recited above, but could also occur in the sequence (b) (a) (c).

In accordance with a second embodiment of the process of the invention, the weft thread that has most recently been inserted into the warp is checked before beating. If the most recently inserted weft thread is defective, the weft freeing means is introduced between the previously inserted weft thread and the most recently inserted weft thread. The freeing means is then shifted towards the reed in order to free the defective thread. After the defective thread has been freed, it is extracted or removed by means of a weft extraction means. If the most recently inserted weft thread is not defective, the weft freeing means remains withdrawn.

Preferably, the defective weft thread, after being freed up from the fabric, is extracted by suction tube by means of a suction means placed near the insertion side of the shed.

Another object of the present invention is to provide apparatus especially designed for carrying out the above-described process. This system utilizes well-known weft-thread sensors capable of determining whether or not the most recently inserted weft thread is defective or not, in combination with means for interrupting the cycle of insertion and stopping the loom if the sensor(s) senses a defective weft thread insertion. Such apparatus in accordance with the said first embodiment of the invention comprises:

A weft freeing means actuated by a double reciprocating motion, including a vertical motion if the weft insertion is not defective, between a high position where the freeing means is situated between the previously inserted weft thread and the weft thread most recently inserted, and a low position where the freeing means is below the fabric; and, a horizontal motion if a defective weft thread is sensed, such horizontal motion occurring between a rearward position where the weft freeing means is also at the high position, and a front position where the freeing means moves toward the reeds; and an extraction means for removing the defective weft thread from the shed area.

Preferably, the freeing means comprises fine needles that penetrate into the fabric being formed when the freeing means is vertically moved and which force the defective weft thread back toward the reed when the freeing means is actuated horizontally. The needles of the freeing means are distributed all along the width of the loom in a sufficient number so as to positively liberate the defective thread from the interior of the warp, whatever be the cause of the fault; e.g., the needles can be spaced every 7 cm.

According to the preferred embodiment of the device, the vertical reciprocating motion of the freeing means is obtained in synchronism with the operation of the reed through a cam system mounted for rotation about the rotation axis of the reed and pivotable with the reed sley shaft. In particular, the freeing means comprises vertical needles, a needle support that can slide vertically and horizontally in a housing fixed to the frame of the loom, a compression spring maintaining the needle support in contact with the surface of a swinging means on which the support rests, and a swinging means intended for following the path of the cam mounted on the rotation shaft of the reed during beat-up displacement of the reed. The path of the cam is such that, before the beating of the reed, the swinging means swings and the needle support is at its low position. In all other positions of the reed, the swinging means and the needle support are in the normal (mid) and in the high position, respectively.

The means for extracting the weft can consist of one or several suction tubes placed on the insertion side of the shed where the insertion of the weft thread has been made. Indeed, when a defective pick has been freed preliminarily from the interior of the warp through the freeing means, a simple suction action appears to be sufficient for extracting the thread.

In the case where the operation of the loom is such that the cycle of insertion is interrupted while the reed is in its beat-up position, after the weft sensor has sensed a defective weft thread, the extraction device in accordance with the invention also comprises loom-control means for reversing the loom and shifting the reed backwards before the freeing means executes its horizontal reciprocating freeing motion, to thereby unlock the weft threads.

On the other hand, in order to avoid any risk of fault prejudicial to the fabric in the case wherein, for one reason or another, the defective weft thread is not extracted from the warp in spite of the proper operation of the system, the system is provided at the extractor with a defective weft thread sensor having the function of keeping the loom stopped if the defective thread has not been extracted by the weft extraction means.

DESCRIPTION OF THE DRAWINGS

The invention will be better understood with reference to the accompanying drawings wherein:

FIGS. 7 to 15 represent diagrammatic illustrations of different operational steps of a variation of the process according to the present invention;

FIG. 19 is a schematic view showing an alternate embodiment of a device for applying the process according to the present invention.

FIGS. 20(*a*) to 20(*c*) correspond to FIG. 17, showing the pivot action of piece 24.

DETAILED DESCRIPTION OF PREFERRED EMBODIMENTS

Figure 2:
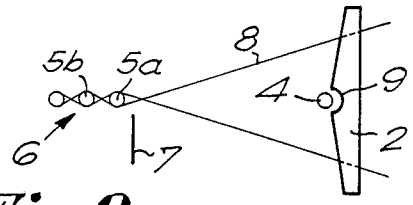
Figure 16:
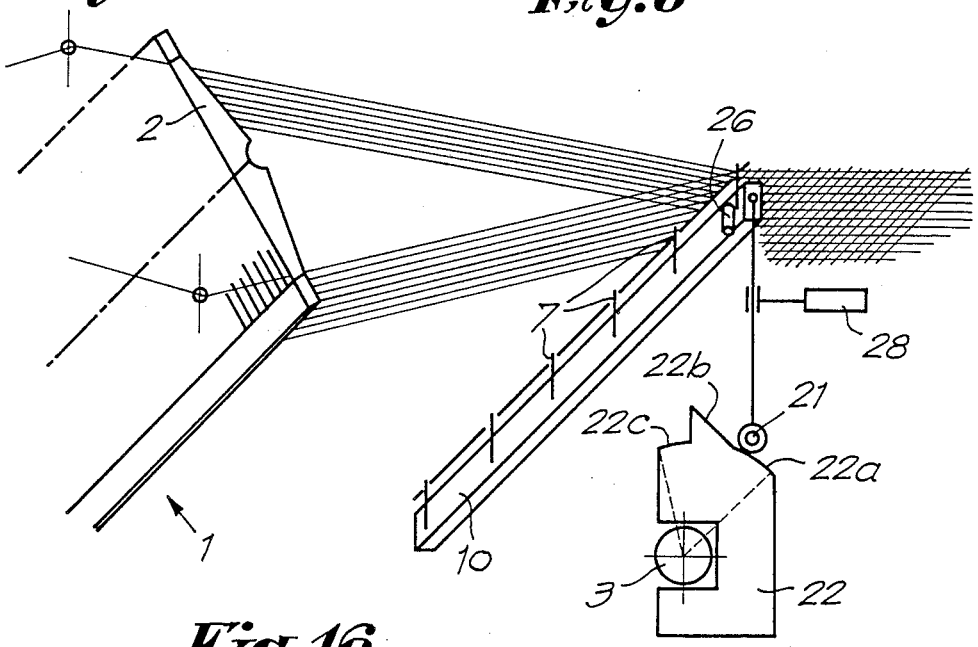
FIG. 16 represents a schematic view of a loom equipped with a device for applying the process according to the present invention.

The weft freeing device of the invention is mounted on a shuttleless (i.e., air jet) loom 1 (FIG. 16) including, a reed 2 which pivots about a circular arc about an axis of rotation 3 (FIGS. 16,17) for beating the weft 8 into the fell of fabric F. With the warp shed open (FIGS. 2,3) the inserted weft thread 4 is beat up into the fell against the other weft threads 5*a* and 5*b* already inserted in the fabric 6 being formed. One of the characteristic features of the weft freeing device is the weft freeing means 7, e.g., multiple upright parallel needles in a row aligned with the beating line of reed 2 and actuated to move horizontally toward and away from the reed and vertically toward and away from the fabric.

Before describing the weft freeing device proper, it is essential to understand the theoretical operation of the motion of the needles 7 throughout the cycle of weft insertion. It is to be understood that each of the steps described below is automatically controlled, for example control means 32 shown in FIGS. 18 and 19.

Figure 3:
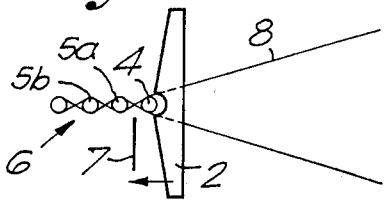

At the end of a cycle of weft insertion, in the absence of any weft insertion fault, reed 2 is in its retracted position (FIG. 1) and the needles 7 are also in their inactive or lower position beneath the fabric. A new weft thread 4 is then inserted (FIG. 2) into the open warp along the reed 2, e.g., in a recess 9 provided therefor. Reed 2 then commences its beating motion and approaches fabric 6 while drawing along the weft thread 4 (FIG. 3).

After insertion, but before the weft thread has been beaten-up into the fell of fabric 6, the weft sensors generally used in a loom determine if thread 4 is positioned all the way across the fabric width or has a fault. For example, sensor 30 shown in FIG. 18 senses the presence of an inserted weft thread at the side of the loom opposite the insertion device, signalling correct positioning to control means 32. If thread 4 is correctly positioned for beat-up, reed 2 beats thread 4 into the fell of fabric 6 and subsequently retracts into its starting position, the warp threads 8 cross each other, and the cycle is repeated starting again as shown in FIG. 1.

On the other hand, if the thread 4 has a fault, i.e., if the weft sensor does not determine the presence of the weft thread 4 all along the machine width of fabric 6, the needles 7 are introduced between the last inserted weft 4 and the previously inserted weft 5*a* by moving vertically upwardly before the beating of said thread 4 against the previously inserted thread 5*a*.

Reed 2 is then retracted from the fabric 6 toward its position of withdrawal by reversal of the loom, after which the needles 7 are moved horizontally to force the defective thread 4 back toward the reed 2, at which time the defective thread can be extracted from the loom.

Figure 1:
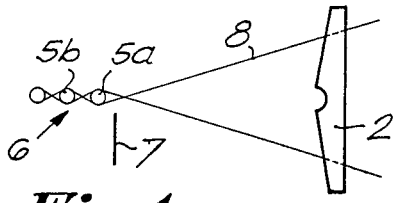
FIGS. 1 to 7 represent diagrammatic illustrations of the different operational steps of the process according to the present invention.
Figure 4:
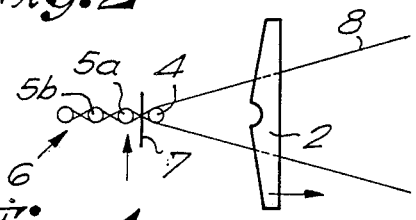
Figure 5:
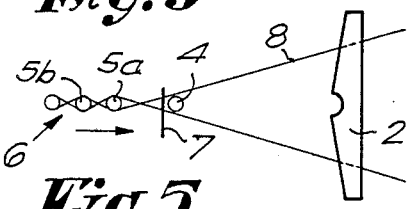
Figure 6:
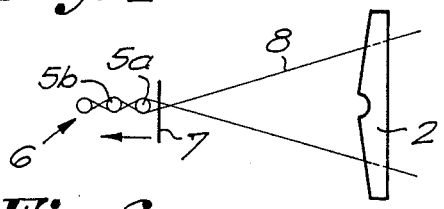

An extraction means, e.g., a suction tube 26 (FIGS. 16 and 18) is actuated and extracts the defective thread 4 from the interior of the warp (FIGS. 5,6) while needles 7 are moved first horizontally in an opposite direction to their position according to FIG. 4, and then vertically down to their lower inactive starting position below the fabric as shown in FIG. 1. A new weft thread is then inserted into the warp, is carried along by the beating motion of reed 2 to the fabric fell, and the cycle recommences from the stage illustrated in FIG. 3 if the pick is good.

FIGS. 7 to 15 represent an alternative version of the process according to which the needles 7 are introduced automatically into the fabric during every cycle of weft insertion. In such case, at the end of the weft insertion, in the absence of a weft fault, reed 2 is in its retracted position (FIG. 7), but needles 7 are normally disposed at their high position situated between the last two inserted weft threads; i.e., the thread 5*a* that has just been inserted and the thread 5*b* that was inserted during the preceding insertion cycle. The warp threads 8 recross, the warp is opened, and a new weft thread 4 is then inserted (FIG. 8) in the shed along the reel in the recess 9 provided therefor.

Figure 9:
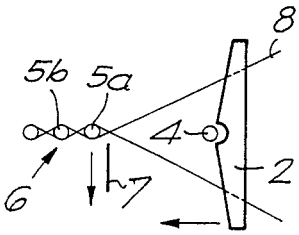

The reed 2 then starts its beating motion and approaches fabric 6 while drawing along the weft thread 4 (FIG. 9). During that displacement, needles 7 move vertically from a high position to a low position below the level of the fabric 6, the latter advancing continuously while the needles 7 pass beneath the weft thread 5*a*. When reed 2 reaches the beating line (FIG. 10), the needles 7 are then moved vertically from their low position to their high position and are located precisely between the last weft thread 5*a* inserted during the preceding cycle and the weft thread 4 that has just been inserted.

Figure 7:
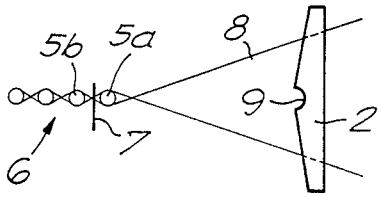
Figure 8:
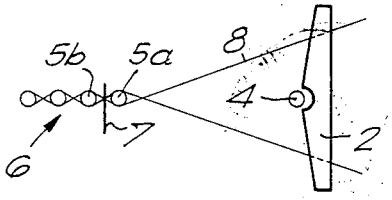

At this moment, the weft thread detectors 30 on the loom 1 determine if thread 4 is correctly positioned or is defective. If thread 4 is correctly positioned (FIG. 11), reed 2 retracts from the fabric 6 to its retracted position, the warp threads 8 recross, and the end-of-cycle is established again as illustrated in FIG. 7.

However, if the thread 4 constitutes a defective pick, for example, if the weft sensor does not determine the presence of thread 4 all along the machine width of fabric 6, reed 2 retracts from fabric 6 toward its retracted position, with the reverse operation of the loom (FIG. 12), and then needle 7 moves horizontally (FIG. 13) to force the defective thread 4 back toward the reed 2.

The sucking tube 26 is then activated and extracts the weft thread 4 from the interior of the warp (FIG. 14) while needle 7 is moved horizontally in a reverse sense so that it returns to its beginning high position. A new weft thread 4' is then inserted by an air jet into the warp (FIG. 15) and is drawn along by reed 2 to the fabric fell by the beating motion of the reed, after which the cycle recommences starting from the step illustrated in FIG. 10.

Figure 17:
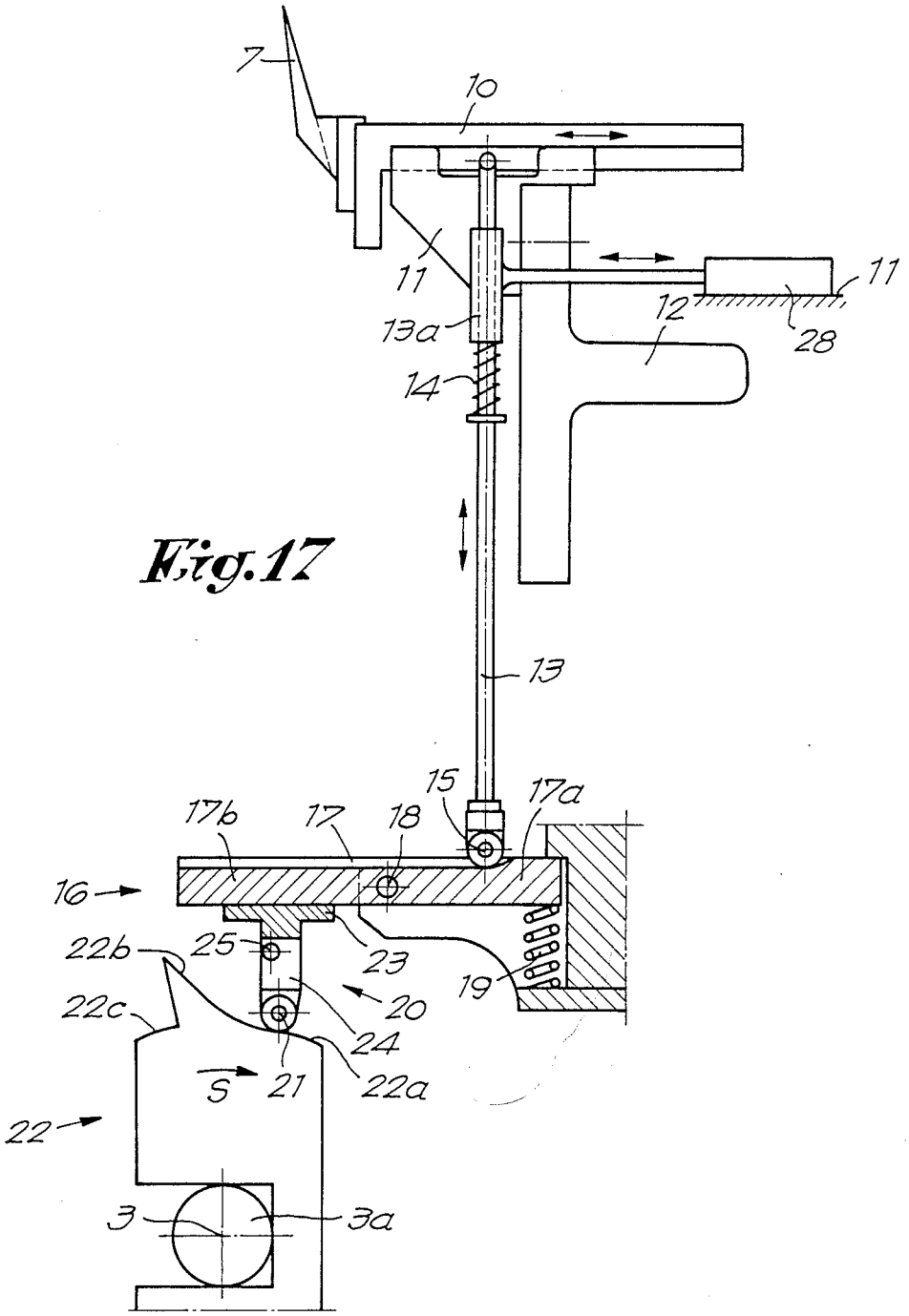
FIG. 17 represents a sectional view of the weft freeing system.
Figure 18:
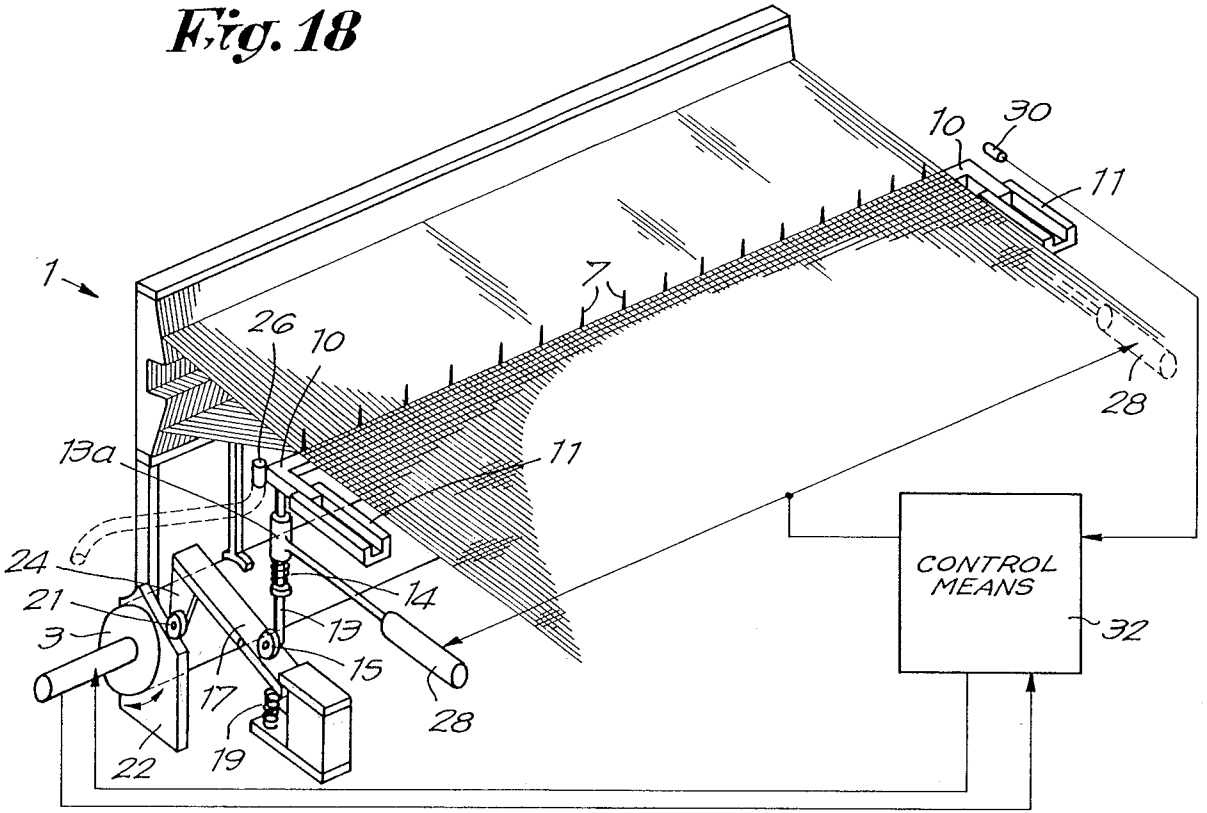
FIG. 18 is a perspective view of a loom including the weft freeing system of FIG. 17.

All of the above-described steps require synchronization of both the motion of reed 2 and the motion of the needles 7 relative to the axis of rotation 3 of reed 2. The needles 7, for example, are fixed across the loom 1 at regular distances of e.g., 7 cm each all along a needle support 10 which extends transversely over the entire width of the loom. As best shown in FIG. 18, the needle support 10 is movable horizontally and vertically in a seat 11, the seat 11 being fixed to frame 12 of loom 1 as shown in FIG. 17. The vertical motion of needle support 10 is ensured by vertical actuator slider 13*a*, rod 13 and spring 14; spring 14 biases rod 13 downwardly and a cam follower roller 15 rides on the top clock-wise side of the vertical actuator drive means 16. When the vertical actuator drive 16 pivots about its pivot 18, rod 13 follows its motion and descends through the action of spring 14, drawing along the needles 7 into their low position.

The vertical actuator drive means 16 consists of a U-section upper guiding or cam element 17 wherein the cam follower roller 15 can move during the horizontal translation of the needle support 10. The element 17 can also pivot around the horizontal axis 18 which extends across the loom width and is fixed at its ends to the frame of the loom 1.

One of the ends 17*a* of element 17 rests against a compression spring 19 which is held by the frame of loom 1; the other end 17*b* of element 17 is attached to a drive cam system 20 including a second cam follower roller 21. This second roller 21 rides on a cam 22 fixed to the sley shaft 3*a* of reed 2 and is pivotable with reed 2 about reed axis of rotation 3.

The drive cam system 20 is designed so as to ensure the following operation. During the rotation of drive cam 22 and pivot shaft 3*a* in the sense of arrow S (FIG. 17) (i.e., beating motion of reed 2 carried by shaft 3*a*), roller 21 first rolls along the circular profile 22*a* of cam 22 having its center at axis 3, element 17 remains horizontal and rod 13 remains in the position corresponding with the high position of the needles 7 (FIGS. 7 and 8), since cam follower 21 is not vertically moved.

The roller 21 then rolls along a curved cam profile 22*b* of cam 22, at which point roller 21 is lifted and 17*b* of the element 17 is pivoted clockwise around the axis 18. End 17*a* of element 17 is biased upwardly by compression spring 19, and the actuator rod 13 which rests on the cam surface of the upper part of the end 17*a* of element 17 moves downwardly under influence of spring 14 to draw the needles 7 down to their low or retracted position (FIG. 9).

Figure 10:
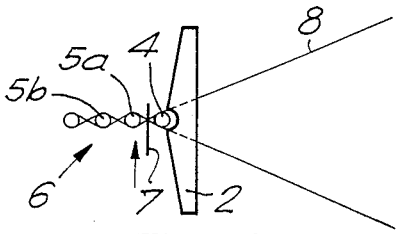
Figure 11:
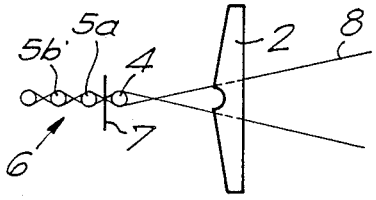
Figure 12:
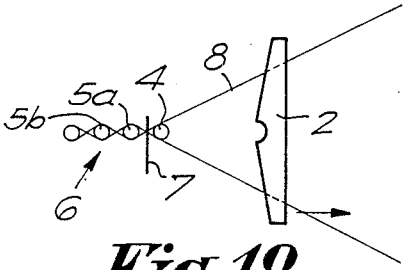

Roller 21 then rises over cam surface 22*b* and drops on surface 22*c*, whereupon element 17 returns to its horizontal position, and the rod 13 is raised with needles 7 to their initial elevated position (FIG. 10).

The drive cam system 20 comprises two pieces 23, 24. Piece 23 is fixed to the bottom part of end 17*b* of element 17, and piece 24 is pivoted to piece 23 through a horizontal pivot pin 25. Piece 24 includes the roller 21 at its lower end. The pivot pin 25 is eccentric relative to pieces 23 and 24 in such a way that piece 24 rests against piece 23 and cannot rotate around the pin 25 in a counter-clockwise sense.

On the contrary, piece 24 can readily pivot relative to piece 23 by pivoting around the axis 25 in a clockwise sense. Thus, as shown in FIGS. 20(*a*) and 20(*b*), when cam 22 pivots clockwise (arrow S), piece 24 transmits vertical motion, but reverse counter-clockwise pivoted motion of cam 22 (FIG. 20(*b*)) causes piece 24 to pivot as shown so cam 22 can clear the drive cam system 20 without driving roller 21 vertically.

Figure 13:
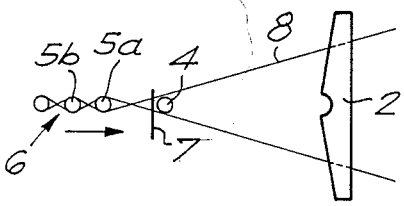
Figure 14:
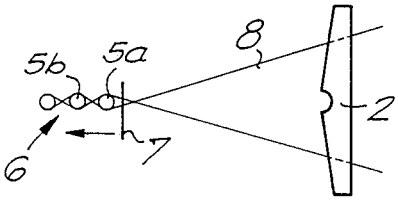
Figure 15:
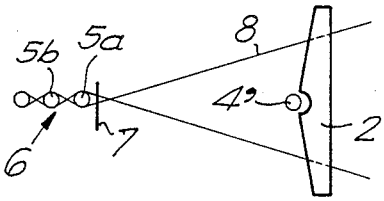

The horizontal motion of needle support 10 is actuated by a screw jack 28 (FIGS. 18 and 19) which moves the needle support 10 horizontally in its seat 11 over a distance corresponding with the displacement needed for forcing a defective thread 4 back towards the reed 2 (i.e., FIG. 13). The screw jack 28 is actuated as soon as reed 2 has reached its retracted position (i.e., FIG. 12) after a defective weft thread 4 has been sensed and then the screw jack returns to its initial position to dispose the needles 7 in their high and rearward position (i.e., FIG. 14).

The defective weft extraction means consists of one or more vacuum or suction tubes 26 fixedly mounted on loom 1. Preferably, tube 26 is placed near the injection nozzle of compressed air which projects the weft thread through the warp, and is mounted at the level of the first needle 7 near the weft insertion side of the shed. The extraction means is controlled so as to start acting when, after the initial detection of a defective weft thread 4, the needles 7 have forced the defective thread 4 back to the reed 2 through the action of the screw jack 28 moving the needle support 10 horizontally.

Other embodiments or variations of the invention apart from that illustrated can be made without departing from the concept of the invention as disclosed herein. For example, the vertical motion of the needles 7 can be actuated by a system of screw jacks 34 (FIG. 19) whose control and course depend upon the motion of the reed. Depending on the loom type and the available space for mounting the device according to the present invention, the technician skilled in the art can provide the optimal solution.

In particular, the distance of 7 cm between two adjacent needles is preferred for most of the pneumatic looms, as it corresponds with the usual gap between the air-injection nozzles along the loom. Likewise, the shape of cam 22 and its profile depend upon the distance between the axis of rotation 3*a* of reed 2 and the needle 7, and on the angle of rotation during the beating and retraction motions of reed 2. FIG. 17 does not show the exact ratio of dimensions, of course, but enables one to visualize the different means used.

The needles 7 should be relatively flexible since they can be deformed occasionally during the forward travel of the fabric, and have to be very thin for not marking the fabric finish. In addition, the process and the device according to the present invention are not limited solely to a pneumatic loom, but apply in general to any shuttleless loom.

It will of course be recognized that screw jacks 28 (or 34) may assume a variety of forms such as that shown in FIG. 19, in which jack 28 includes a nut 35, element 36 is a screw, and element 37 is a motor. Arrows A and B in FIG. 19 indicate the horizontal motion of needle support 10 in response to turning of screw jacks appropriately mounted in slots 38 of support 11.

We claim:

1. A process for freeing up and extracting a defective weft thread from the cloth fell in a shuttleless loom which includes a loom shed and a beat-up device having means for beating up successively inserted weft threads into a cloth fell line, comprising the steps of:

carrying out a weaving operation including beating up of each inserted weft thread until a mispick is detected;

introducing at least one needle-like freeing means for freeing a defective weft thread into the cloth fell line between a previously inserted beat-up weft and a last inserted weft before each beat-up;

withdrawing the freeing means if no mispick occurs;

upon detection of a mispick, moving the freeing means toward the loom beat-up device to free the mispicked weft thread from the fell line and to move it toward the loom shed; and extracting the freed mispicked weft thread from warp threads in the loom shed.

2. A process as claimed in claim 1, wherein the step of extracting the freed weft thread is carried out by section.

3. A process as claimed in claim 1, wherein the step of introducing the needle-like freeing means includes the step of introducing a plurality of spaced-apart needle-like freeing means disposed in a single row across the loom width into the fell line.

4. A process for freeing up and extracting a mispick from a shuttleless loom having a mispick detector, a loom stopping and reversing system operated in response to detection of a mispick, and beat-up means for beating-up successively inserted weft threads into a cloth fell line, comprising the steps of:

carrying out a weaving operation including beating up each inserted weft thread until a mispick is detected;

upon detection of a mispick, inserting at least one needle-like freeing means for freeing a mispicked weft thread between the mispicked weft and a previous inserted weft thread at the fell line before beating up the mispicked weft;

bringing the beat-up means to a retracted position;

after insertion of the weft freeing means, actuating the weft freeing means so that the weft freeing means and the mispicked weft thread are advanced toward the beat-up means, to thereby free the mispicked weft thread;

extracting the freed weft thread from the warp threads;

actuating the weft freeing means to return them to their former position at the cloth fell line;

resuming the weaving operation, including withdrawing the weft-freeing means out of the fell line so as to permit free passage of the cloth past the weft-freeing elements.

5. A process according to claim 4, wherein the step of extracting the freed weft thread is carried out by suction.

6. A process as claimed in claim 4, wherein the step of introducing the needle-like freeing means includes the step of introducing a plurality of spaced-apart needle-like freeing means disposed in a single row across the loom width into the fell line.

7. An apparatus for freeing up a mispicked weft thread in a shuttleless loom which includes a loom shed and beat-up means including a beat-up element mounted on a beat-up shaft for reciprocating movement in synchronism with loom operation to beat-up successively inserted wefts into a cloth fell line, a beat-up motion occurring as pivotal movement of the beat-up element about a beat-up shaft axis, comprising:

means for detecting a defective pick and retracting the beat-up means in response thereto;

at least one weft freeing needle element mounted on the loom by support means disposed adjacent the cloth fell line;

first actuator means for actuating said at least one needle element for movement into and out of the cloth fell line in synchronism with the beat-up means in a direction generally transverse to the warp plane of the loom at the fell line;

second actuator means for actuating said at least one needle element for movement toward and away from the beat-up element in its retracted position while said at least one needle element is disposed generally in the warp plane of the loom at the fell line; and means for controlling said second actuator means in order to move said at least one needle element only in response to detection of a just inserted defective pick before beat-up of the just inserted defective pick to engage and free the just inserted defective pick by disengaging it from the fell and moving it back toward the beat-up element after the latter is retracted from its approximate beat-up position.

8. An apparatus as recited in claim 7, wherein said at least one weft freeing needle element comprises a plurality of parallel needle elements spaced across the loom width along the cloth fell line in a single row.

9. An apparatus as recited in claim 8, wherein said loom is an air jet loom, and wherein said needle elements are spaced 7 cm apart.

10. An apparatus as recited in claim 7, including a defective pick thread extracting means associated with said at least one needle element for extracting from the warp threads a defective pick after it has been freed by said at least one needle element and moved toward the beat-up element.

11. An apparatus as recited in claim 10, said extracting means comprising a suction tube.

12. An apparatus as recited in claim 11, wherein said suction tube is mounted for movement with said at least one needle element.

13. An apparatus as recited in claim 7, said first actuator means including cam means driven in synchronism with the beat-up element and with a cam follower and a drive actuator system and drive actuator system associated with the cam means and connected to the needle support means, said cam means synchronizing at least said generally vertical motion of said needle element with the beat-up motion.

14. An apparatus as recited in claim 13, wherein the cam means comprises a cam mounted on a shaft of the beat-up element.

15. An apparatus as recited in claim 14, wherein said at least one needle element is normally disposed so as to intersect a plane of the cloth fell line during weaving and said cam means and said cam follower and drive actuator system include means for preventing initial beat-up motion from causing motion of said at least one needle element, and thereafter, for causing the needle to be sequentially moved, in response to full beat-up motion, out of the plane of the cloth fell line and subsequently moved back into a position whereat it intersects said cloth fell line plane.

16. An apparatus as recited in claims 13 or 14, wherein the cam follower comprises an element which is pivotable around an axis, an end of said element cooperating with said cam means and another end resting against a compression spring, said other end also being connected to said support means.

17. An apparatus as recited in claim 15, wherein a surface of the cam means comprises two circular portions and a peak portion located between said circular portions, and wherein the cam follower includes a pivotable cam drive system, the peak portions of the cam means transmitting a vertical downward motion to the needles only during the beat-up motion.

18. An apparatus for freeing up a mispicked weft thread in a shuttleless loom which includes a loom shed and beat-up means including a beat-up element mounted on a beat-up shaft for reciprocating movement in synchronism with loom operation to beat-up successively inserted wefts into a cloth fell line, a beat-up motion occurring as pivotal movement of the beat-up element about a beat-up shaft access, comprising:

means for detecting a defective pick and retracting the beat-up means in response thereto;

at least one weft freeing needle element mounted on the loom by support means disposed adjacent the cloth fell line;

first actuator means for actuating said at least one needle element for movement into and out of the cloth fell line in a direction generally transverse to the warp plane of the loom at the fell line;

second actuator means for actuating said at least one needle element for movement toward and away from the beat-up element in its retracted position while said at least one needle element is disposed generally in the warp plane of the loom at the fell line; and means for controlling both of said actuator means in order to move said at least one needle element into the fell line only in response to detection of a just inserted defective pick before beat-up of the just inserted defective pick to engage and free the just inserted defective pick by disengaging it from the fell and moving it back toward the beat-up element after the latter is retracted from its beat-up position.

19. An apparatus as claimed in claim 18, wherein said at least one weft freeing needle element comprises a plurality of parallel needle elements spaced across the loom width along the cloth fell line in a single row.

20. An apparatus as claimed in claim 19, wherein said loom is an air jet loom, and wherein said needle elements are spaced 7 cm apart.

21. An apparatus as claimed in claim 18, including a defective pick thread extracting means for extracting from the warp threads a defective pick after it has been freed by said at least one needle element and moved toward the beat-up element.

22. An apparatus as claimed in claim 21, wherein said extracting means comprises a suction tube.

23. An apparatus as claimed in claim 22, further comprising means for mounting said suction tube for movement with said at least one needle element.

* * * * *